United States Patent [19]

Samson et al.

[11] Patent Number: 4,690,651

[45] Date of Patent: Sep. 1, 1987

[54] INFLATABLE AQUATIC DEVICE

[76] Inventors: Sam Samson, 150 Bennett Ave., New York, N.Y. 10040; Mark J. Gruenspecht, 81-16 Chevy Chase St., Jamaica, N.Y. 11432

[21] Appl. No.: 823,085

[22] Filed: Jan. 27, 1986

[51] Int. Cl.[4] ..... A63B 31/02

[52] U.S. Cl. ..... 441/56; 441/57

[58] Field of Search ..... 441/55, 56, 57, 58; 2/16, 17; D21/237, 238, 239; 273/67 B

[56] References Cited

U.S. PATENT DOCUMENTS

| | | | |
|---|---|---|---|
| 216,455 | 6/1879 | Primbs . | |
| 789,428 | 5/1905 | Hruby et al. . | |
| 1,457,858 | 7/1922 | Ruddell . | |
| 1,535,481 | 4/1925 | Kjelgaard | 441/56 |
| 1,611,427 | 10/1925 | Evans . | |
| 1,684,714 | 9/1928 | Perry . | |
| 2,536,390 | 1/1951 | Pobochenko . | |
| 3,122,760 | 3/1964 | Glass . | |
| 3,174,167 | 8/1963 | Pauley . | |
| 3,286,287 | 8/1964 | Martin . | |
| 3,802,009 | 4/1974 | Clemente . | |
| 3,874,014 | 4/1975 | Davey . | |
| 4,121,312 | 10/1978 | Penney . | |

FOREIGN PATENT DOCUMENTS

| | | | |
|---|---|---|---|
| 2525932 | 12/1976 | Fed. Rep. of Germany | 441/58 |
| 13465 | of 1889 | United Kingdom | 441/56 |
| 11782 | 3/1905 | United Kingdom | 441/123 |

*Primary Examiner*—Jeffrey V. Nase
*Assistant Examiner*—Thomas J. Brahan
*Attorney, Agent, or Firm*—Lewis H. Eslinger

[57] ABSTRACT

An inflatable aquatic device has a single inflatable, flotation chamber with a rigid flange element circumscribing the periphery of the inflatable chamber and a flexible lower sheet also attached to the chamber. The aquatic device conforms generally to a size for utilizing on the hand of a user and the flat, lower sheet, which is adhered at its edges to the inflatable chamber, is formed with apertures through which fingers and thumb of the user may pass, thereby permitting the user to utilize his hand for grasping objects and the like and yet still have the flotation chamber firmly attached thereto. The flange element is tapered so that it is deformed from a planar two-dimensional surface into a curved, three-dimensional surface to form a scoop-like element on the lower side and a curved water run-off channel on the upper side.

6 Claims, 6 Drawing Figures

INFLATABLE AQUATIC DEVICE

BACKGROUND OF THE INVENTION

1. Field of the Invention

The present invention relates generally to aquatic devices and, more particularly, to an inflatable aquatic device for fitting over a user's hand to provide flotation thereto yet permit the user to manipulate his fingers for grasping objects.

2. Description of the Background

There are presently known various forms and configurations of inflatable flotation devices, such as inner tubes and the like which are intended to provide buoyancy to a person in the water, and these devices can be used both for recreational, as well as lifesaving, purposes. There have also been proposed various kinds of devices that are intended to increase a person's ability to propel himself through the water, such as swim fins, for use both on the hands and feet of a swimmer. Generally, these latter devices are not inflatable but are intended only to increase the surface areas of the hands and feet as used in swimming.

A principal drawback with most of the heretofore known devices that fit over the hands relates to the cumbersomeness and relative large size of such devices. This results in restricting the ability of the user to manipulate his hands, not only to don the various devices but also to use the hands in potential life-threatening situations, such as grasping a rope or life-preserver ring.

SUMMARY OF THE INVENTION

Accordingly, it is an object of the present invention to overcome the aforementioned disadvantages inherent in the prior art.

It is another object of the present invention to provide an inflatable aquatic device, one placed over each hand of a swimmer, to both increase the buoyancy of the swimmer and also to improve his ability to propel himself through the water when swimming.

It is yet another object of the present invention to provide an inflatable aquatic device in which buoyancy and swimming ability are improved yet which does not adversely inhibit the ability of the user to manipulate the fingers and thumb of each hand.

It is still another object of the present invention to provide an inflatable aquatic device useful in swim training and physical therapy.

A further object of the present invention is to provide a device of the character described that is formed of durable yet inexpensive material and that may be efficiently and inexpensively manufactured.

In accordance with an aspect of the present invention, an inflatable aquatic device, one for use on each hand, comprises an inflatable chamber that is provided with an easily operated valve and a rigid, peripheral rim or flange, which is tapered rearwardly relative to the orientation of the hand, and in which the inflatable chamber is attached to a lower element that is formed of relatively strong, fabric-reinforced, flexible material that includes finger holes and a thumb hole through which the user's fingers and thumb may protrude. The finger holes and thumb hole may be further reinforced to prevent tearing or rupturing of the reinforced material at those locations. The peripheral flange is tapered and so attached to the inflatable chamber so that when the inventive device is inflated a scoop is formed on the downwardly facing side and the upward side forms a channel with the inflated chamber so that the water is permitted to run off more expeditiously. The inflatable chamber can be formed having an increased size relative to a cylinder of comparable dimensions and such expanded air chamber can be created by heat forming an upper sheet of material used to form the chamber, so that it is stretched out of shape, thereby increasing its volume when inflated. Additionally, in one embodiment, the two inflatable aquatic devices intended to be placed over the respective hands of the user can be mutually attached by means of an interconnecting web, which can also include further inflatable chambers, and which has an aperture through which the head of the user can be inserted, thereby to provide a life-saving device useful if the user becomes unconscious.

The above and other objects, features, and advantages of the present invention will become apparent from the following detailed description of illustrative embodiments thereof to be read in conjunction with the accompanying drawings, in which like reference numerals represent the same or similar elements.

DETAILED DESCRIPTION OF PREFERRED EMBODIMENTS

Figure 1:
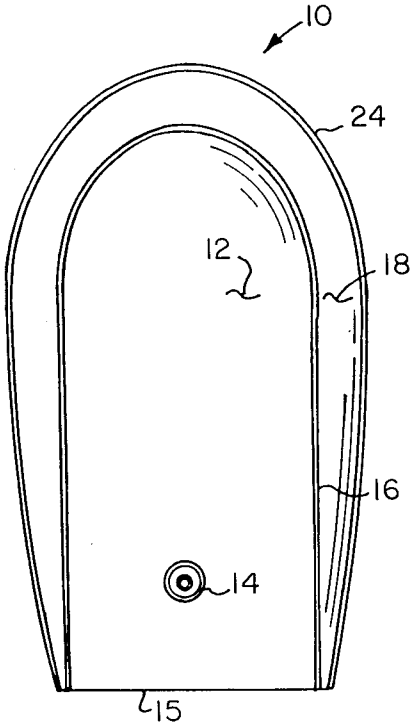
FIG. 1 is a top plan view of an inflatable aquatic device in accordance with an embodiment of the present invention.

FIG. 1 shows an inflatable aquatic device 10 in a top plan view as comprising a main inflatable chamber 12 formed of flexible plastic material and having a valve 14 arranged in one wall of inflatable chamber 12. Inflatable chamber 12 can be formed of one sheet of plastic material folded over on itself and sealed all around its periphery, with the fold being along the rearward edge 15. Such seal or seam is represented at 16 in FIG. 1, and this seam can be formed by heat sealing or electron beam welding, for example. The seal 16 is not formed at the outermost edges of the folded-over sheet, however, but is moved inwardly so as to define two peripheral elements, a top skirt 18 and a bottom skirt, the bottom skirt is not seen in FIG. 1. A rigid, flat, tapered flange element also not seen in FIG. 1 is inserted between the skirts and the outermost thereof edges are sealed, by way of seam 24. This seam 24 can be heat sealed or electron beam welded.

Figure 2:
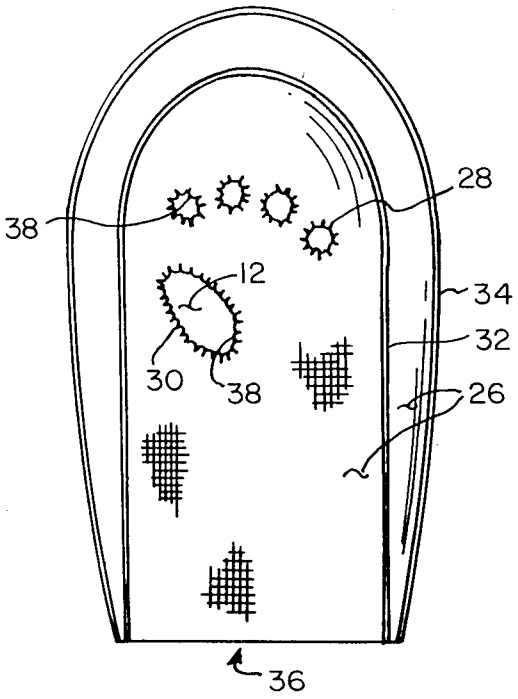
FIG. 2 is a bottom plan view of the device of FIG. 1.

In order to attach the device 10 to the hand of the user a lowermost sheet 26 is adhered to the inflatable chamber 12 and is also formed of flexible material, which may be strengthened preferably by the inclusion of fabric reinforcement or fiber glass or the like. FIG. 2 shows the manner in which lowermost sheet 26 is provided with a suitable number of through-holes for the user's fingers and thumb to protrude through, with the finger holes shown generally at 28 and the thumb hole at 30.

Bottom sheet 26 is of the same general size as the folded-over plastic sheet that forms inflatable chamber 12 and is attached thereto along the same seams 16, 18 that were shown in FIG. 1. That is, seam 32 corresponds to seam 16 and seam 34 corresponds to seam 24. Additionally, is this view, the form of the flange element is seen tapering towards the rear of the device, that is, toward a location 36 at which the user inserts his hand prior to inflation of inflatable chamber 12. Because the flange element is integrally formed with the inflatable chamber, when the device is inflated the flange deforms with advantageous results. For example, the flange element increases the swimming abilities of the user, so that by providing a tapering of the flange the water run-off is accentuated and the device is more streamlined in the water. The flat element forming the flange can be plastic or metal to increase manufacturability, and one or more flange elements can be stacked on top of each other in order to provide a thicker flange. The flange element further defines the shape of the inventive device 10.

As seen in FIG. 2, the finger holes 28 and thumb hole 30 through which the user's fingers and thumb (not shown) respectively protrude can be formed having scallopped edges, shown generally at 38, to permit movement of the fingers and to accommodate various finger sizes. Additionally, these holes 28, 30 could be reinforced by additional material or gussetting to prevent tearing of the bottom fabric-reinforced layer 26.

Figure 4:
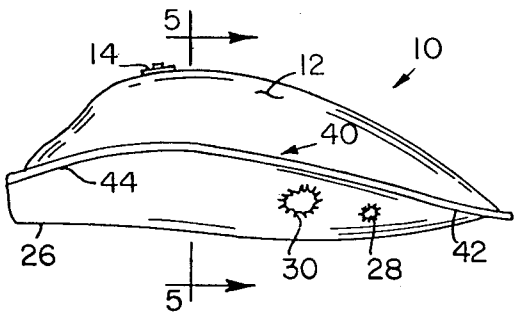
FIG. 4 is a side elevational view of the device of FIG. 1 in an inflated condition.
Figure 3:
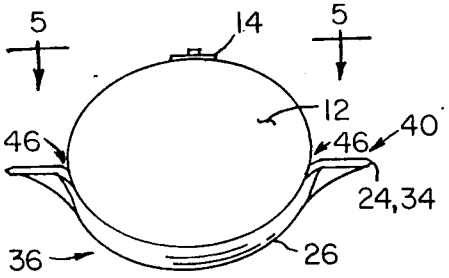
FIG. 3 is a rear elevational view of the device of FIG. 1.

Upon inflating the inventive device 10, it will appear from the rear as shown in FIG. 3 and from the side as shown in FIG. 4. The rear of the inflated chamber 12 at fold 15 forms a rounded surface, and it is at location 36 between chamber 12 and lower sheet 26 that the user's hand is inserted prior to inflation. The deformation of tapered flange 40 can be clearly seen in FIGS. 3 and 4.

Air valve 14 is advantageously arranged at the rear portion of inflated chamber 12 to facilitate inflation by the user after the inflatable device 10 has been placed over the hand. It is appreciated, of course, that the present invention is not intended to be first inflated and then subsequently placed over the hand but, rather, first placed in an operable position with the user's fingers protruding through the appropriate apertures and then the inflatable chamber inflated by the user blowing into valve 14, which can be of the kind that is self-sealing or sealed by mouth actuation.

FIG. 4 shows clearly the manner in which flange 40 is deformed into a three-dimensional surface and, more particularly the leading or front edge 42 of flange 40 becomes downwardly facing, thereby forming a scoop-like element to increase the swimming ability of the user. The trailing or rearward edge 44 of flange 40 also is tilted downwardly and cooperates with a channel 46 that is formed along seam 16 when chamber 12 is inflated to provide a run-off channel for water during use. Channel 46 is seen in FIG. 3 as being on both sides of inflated chamber 12.

Figure 5:
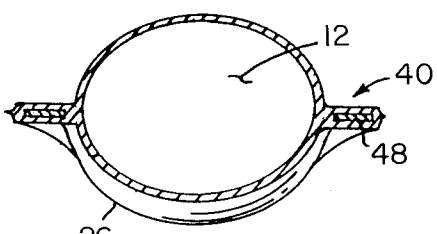
FIG. 5 is a cross-sectional view taken along section line 5—5 of FIGS. 3 and 4.

The cross-sectional view of FIG. 5 shows that the channel 46 does not extend around the periphery of the device 10, but exists only along the downwardly sloping portion 44 of flange 40. The cross section along lines 5—5 of FIG. 5 is taken roughly at the transition point along flange 40, where it changes direction of the curvature that occurs when it is deformed by inflating chamber 12. In FIG. 5 the rigid, flat element 48 that is inserted between the skirt elements, as described above in relation to FIG. 1, is seen. It is understood that although element 48 is rigid, because it is flat it can flex longitudinally, thereby permitting such deformation as shown in FIG. 4. Element 48 can be metal or plastic and while only one such element is provided in the embodiment of FIG. 5, additional elements may be stacked, one on top of another, to provide increased rigidity.

Figure 6:
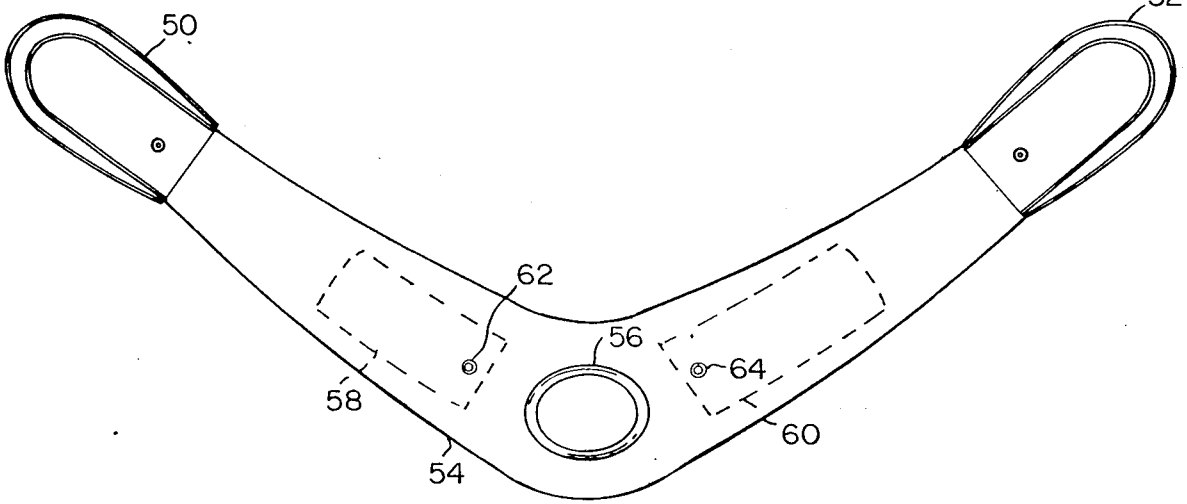
FIG. 6 is a schematic representation of another embodiment of the present invention.

Referring to FIG. 6, a further embodiment of the present invention is schematically represented in which two identical elements 50, 52, such as shown in FIGS. 1 through 5, are arranged at either end of a third substantially flat, flexible element 54 that has a suitable aperture 56 formed therein through which the user's head (not shown) may be inserted. Such aperture 56 preferably is formed as a tapered collar or is sized sufficiently small, so that it would be relatively difficult to remove the user's head once it has been inserted thereinto. Furthermore, interconnecting element has provided with one or more inflatable chambers 58, 60, each of which has its own valve 62, 64, respectively. This embodiment is useful as an emergency, life-saving device, in which if one is required to be in the water for a long period of time or if the device is to be used with an unconscious person, the head of the user is inserted through the center aperture 56 and the hands inserted into the respective inflatable devices 50, 52, and all available inflatable chambers are inflated. The relative dimension of this embodiment are chosen so that swimming or treading water can take place yet the user's head is supported out of the water by the center element 54 and the two inflated chambers 58, 60. That is, the distance between the two end elements 50, 52 can be advantageously somewhat short of the actual arm span of the intended user, so that swimming is not adversely inhibited, yet all the inflatable chambers combine to provide buoyancy to the user, who may be in an unconscious state.

Further modifications of the embodiment of FIG. 6 may comprise having no inflatable chambers in the center element 54, or having more chambers than the two shown, or varying the length of the interconnecting element 54.

Although specific embodiments of the invention have been described in detail herein, with reference to the accompanying drawings, it is to be understood that the invention is not limited to those embodiments and that various changes and modifications can be effected therein by one skilled in the art without departing from the scope or spirit of the invention, as defined in the appending claims.

What is claimed is:

1. An inflatable aquatic device for use by a swimmer, comprising:

an inflatable chamber formed of flexible material;

a valve formed in said inflatable chamber to effect inflation and deflation thereof;

a flexible sheet element having a front and a rear and being attached to said inflatable chamber substantially around its periphery and including a non-attached peripheral portion at said rear adapted to receive a hand of the swimmer when said inflatable chamber is deflated, said flexible sheet element including a plurality of apertures formed through flat surfaces of said sheet material, through which fingers and thumb of the hand can protrude after being received therein; and a rigid, U-shaped, flange element having a continuously variable width being wider at a location corresponding to said front of said sheet element and becoming less wide at locations corresponding to said rear of said sheet element, and being attached to said inflatable chamber along the peripheral portion thereof coextensively with said flexible sheet element, the arms of said U-shaped flange being arranged at the rear thereof said flange element being adapted to be substantially flat when said inflatable chamber is uninflated and being curved downwardly relative to said flexible sheet element at said front and said rear when said inflatable chamber is inflated.

2. An inflatable aquatic device according to claim 1, in which said flexible sheet element is formed of a fabric-reinforced plastic material.

3. An inflatable aquatic device according to claim 1, in which said plurality of apertures formed in said flexible sheet element include means for adapting said aperture to various size fingers.

4. An inflatable aquatic device according to claim 3, in which said means for adapting includes scallopped interior edges formed on each of said plurality of apertures.

5. An inflatable aquatic apparatus for use by a swimmer, comprising:

first and second inflatable chambers, each including a valve for permitting said inflatable chamber to be inflated and deflated, each including a flexible sheet element having a front and rear and being attached to said inflatable chamber substantially around its periphery and including a non-attached peripheral portion at said rear adapted to receive a hand of the swimmer when said inflatable chamber is deflated, said flexible sheet element including a plurality of apertures through flat surfaces of said sheet element, through which fingers and thumb of the hand can protrude after being received therein, and each including a U-shaped, planar flange element having a continuously varying width tapering from a wider portion to two narrower portions from said front to said rear, respectively, of said flexible sheet element, and being attached to said inflatable chamber along the peripheral portion thereof coextensively with said flexible sheet element, said flange element being adapted to be substantially flat when said inflatable chamber is uninflated and being curved downwardly toward said front and rear relative to said flexible sheet element when said inflatable chamber is inflated; and an elongate interconnecting element attached to said first and second inflatable chambers, and including a central aperture arranged to receive therethrough the head of the swimmer.

6. An inflatable aquatic apparatus according to claim 5, in which said interconnecting element includes at least one inflatable chamber integrally formed therewith, and means for inflating and deflating said at least one inflatable chamber.

* * * * *